US008890907B2

(12) United States Patent
Kanamori et al.

(10) Patent No.: US 8,890,907 B2
(45) Date of Patent: Nov. 18, 2014

(54) METHOD OF CONTROLLING ELECTRO-OPTICAL DEVICE, CONTROL DEVICE FOR ELECTRO-OPTICAL DEVICE, ELECTRO-OPTICAL DEVICE, AND ELECTRONIC APPARATUS

(75) Inventors: Hiroaki Kanamori, Suwa (JP); Toshimichi Yamada, Suwa-gun (JP)

(73) Assignee: Seiko Epson Corporation, Tokyo (JP)

( * ) Notice: Subject to any disclaimer, the term of this patent is extended or adjusted under 35 U.S.C. 154(b) by 216 days.

(21) Appl. No.: 13/439,765

(22) Filed: Apr. 4, 2012

(65) Prior Publication Data

US 2012/0262498 A1 Oct. 18, 2012

(30) Foreign Application Priority Data

Apr. 12, 2011 (JP) ..... 2011-088214

(51) Int. Cl.
*G09G 5/00* (2006.01)
*G09G 3/34* (2006.01)

(52) U.S. Cl.
CPC ..... *G09G 3/344* (2013.01); *G09G 2300/08* (2013.01); *G09G 2320/0209* (2013.01)
USPC ..... 345/690; 345/89; 345/107; 345/208; 359/238; 359/296

(58) Field of Classification Search
USPC ..... 345/89, 107, 204, 612–614, 690–699, 345/208; 257/E27.131–E27.141; 349/33–48, 139–152; 359/296, 238
See application file for complete search history.

(56) References Cited

U.S. PATENT DOCUMENTS

| | | | | |
|---|---|---|---|---|
| 6,873,451 | B2 * | 3/2005 | Ukigaya | 359/296 |
| 7,528,822 | B2 * | 5/2009 | Amundson et al. | 345/107 |
| 7,701,436 | B2 * | 4/2010 | Miyasaka | 345/107 |
| 7,786,974 | B2 * | 8/2010 | Zhou et al. | 345/107 |
| 7,812,812 | B2 * | 10/2010 | Yoshinaga et al. | 345/107 |
| 2002/0005832 | A1 | 1/2002 | Katase | |
| 2005/0041004 | A1 * | 2/2005 | Gates et al. | 345/87 |
| 2005/0162725 | A1 * | 7/2005 | Childers | 359/237 |
| 2005/0179706 | A1 * | 8/2005 | Childers | 345/690 |
| 2006/0262080 | A1 * | 11/2006 | Matsuda | 345/107 |
| 2007/0091117 | A1 * | 4/2007 | Zhou et al. | 345/619 |
| 2009/0237351 | A1 * | 9/2009 | Kanamori et al. | 345/107 |
| 2010/0001946 | A1 * | 1/2010 | Murayama et al. | 345/107 |
| 2010/0118046 | A1 * | 5/2010 | Miyasaka et al. | 345/589 |
| 2011/0216055 | A1 * | 9/2011 | Chiu et al. | 345/212 |
| 2012/0098873 | A1 * | 4/2012 | Kanamori | 345/690 |
| 2012/0262505 | A1 * | 10/2012 | Muto et al. | 345/691 |

FOREIGN PATENT DOCUMENTS

JP 4557068 B 10/2010

* cited by examiner

*Primary Examiner* — Lun-Yi Lao
*Assistant Examiner* — Elliot Deaderick
(74) *Attorney, Agent, or Firm* — ALG Intellectual Property, LLC

(57) ABSTRACT

A method of controlling an electro-optical device includes controlling a driving section such that, when an image is rewritten from a first image displayed in a first gradation to a second image including a background image portion to be displayed in the first gradation and a main image portion to be displayed in a second gradation, the same potential as a counter electrode is supplied to a pixel in the background image portion, and a potential corresponding to the second gradation is supplied to a pixel in the main image portion. The driving section is controlled such that at least one of the magnitude and application time of a voltage applied between the pixel electrode and the counter electrode is smaller in a pixel corresponding to an edge portion in the main image portion than in a pixel corresponding to a non-edge portion in the main image portion.

6 Claims, 10 Drawing Sheets

910

| GRADATION DIFFERENCE | VOLTAGE APPLICATION TIME |
|---|---|
| 1 | T11 |
| 2 | T12 |
| 3 | T13 |

T13<T12<T11

METHOD OF CONTROLLING ELECTRO-OPTICAL DEVICE, CONTROL DEVICE FOR ELECTRO-OPTICAL DEVICE, ELECTRO-OPTICAL DEVICE, AND ELECTRONIC APPARATUS

BACKGROUND

1. Technical Field

The present invention relates to technical fields of a method of controlling an electro-optical device, such as an electrophoretic display, a control device for an electro-optical device, an electro-optical device, and an electronic apparatus.

2. Related Art

As an example of this type of electro-optical device, an electrophoretic display is known in which a voltage is applied between a pixel electrode and a counter electrode with an electrophoretic element including electrophoretic particles interposed therebetween, and electrophoretic particles, such as black particles and white particles, are moved to display an image in a display section (for example, see Japanese Patent No. 4557068). The counter electrode may be called a common electrode.

In this electrophoretic display, a driving method (hereinafter, appropriately referred to as "partial rewrite driving") is used in which, when an image which displayed in the display section is rewritten, if an image is merely partially changed, a driving voltage based on a gradation to be displayed is applied between the pixel electrode and the counter electrode only in a pixel corresponding to a changing portion to partially rewrite an image.

In the electrophoretic display which uses the above-described partial rewrite driving, a pixel (that is, a pixel where a gradation should be changed) where the driving voltage is applied between a pixel electrode and a counter electrode may electrically affect another pixel (that is, a pixel where a gradation is not changed) adjacent to the pixel to which the driving voltage is not applied, and the gradation of another pixel may be changed. That is, an electric field which is generated when the driving voltage is applied between the pixel electrode and the counter electrode in the pixel where the gradation should be changed may spread to a part between the pixel electrode and the counter electrode in another pixel where the gradation should be maintained, the electrophoretic particles in another pixel may be moved due to the electric field, and the gradation may be changed. Accordingly, there is a technical problem in that an image to be displayed may not be appropriately displayed, for example, an image having an edge wider than an image to be displayed in the display section may be displayed, or the like.

SUMMARY

An advantage of some aspects of the invention is that it provides a method of controlling an electro-optical device, a control device for an electro-optical device, an electro-optical device, and an electronic apparatus capable of suppressing image spread and displaying a high-quality image.

An aspect of the invention provides a method of controlling an electro-optical device. The electro-optical device includes a display section which has a plurality of pixels each having an electro-optical material between a pixel electrode and a counter electrode arranged to be opposite each other, and a driving section which supplies a data potential to the pixel electrode of each of the plurality of pixels. The method includes controlling the driving section such that, when an image displayed in the display section is rewritten from a first image displayed in a first gradation to a second image including a background image portion to be displayed in the first gradation and a main image portion to be displayed in a second gradation different from the first gradation, the same potential as the counter electrode is supplied to the pixel electrode of the pixel corresponding to the background image portion as the data potential, and a potential corresponding to the second gradation is supplied to the pixel electrode of the pixel corresponding to the main image portion as the data potential. In the controlling of the driving section, the driving section is controlled such that at least one of the magnitude and application time of a voltage applied between the pixel electrode and the counter electrode is smaller in the pixel corresponding to an edge portion in the main image portion than in the pixel corresponding to a non-edge portion excluding the edge portion in the main image portion.

The electro-optical device which is controlled by the method of controlling an electro-optical device according to the aspect of the invention is, for example, an active matrix driving electrophoretic display or the like. For example, the electro-optical device includes a display section which has a plurality of pixels arranged in a matrix, and a driving section which supplies a data potential based on image data to the pixel electrode of each pixel. The driving section supplies the data potential to the pixel electrode in each of a plurality of pixels, such that an image based on image data is displayed in the display section.

With the method of controlling an electro-optical device according to the aspect of the invention, when an image displayed in the display section is rewritten from a first image (for example, full white image) displayed in a first gradation to a second image including a background image portion to be displayed in the first gradation and a main image portion to be displayed in a second gradation (for example, black) different from the first gradation, in the controlling of the driving section, the driving section is controlled such that the same potential as the counter electrode is supplied to the pixel electrode of the pixel corresponding to the background image portion as the data potential, and a potential corresponding to the second gradation is supplied to the pixel electrode of the pixel corresponding to the main image portion as the data potential. That is, according to the aspect of the invention, the driving section is controlled such that, when the image displayed in the display section is rewritten from the first image to the second image, a voltage is not applied between the pixel electrode and the counter electrode of a pixel (that is, a pixel where the gradation is not changed from the first gradation) corresponding to the background image portion of the second image, and a voltage corresponding to the second gradation is applied between the pixel electrode and the counter electrode of a pixel (that is, a pixel where the gradation should be changed from the first gradation to the second gradation) corresponding to the main image portion of the second image.

According to the aspect of the invention, in particular, in the controlling of the driving section, the driving section is controlled such that at least one of the magnitude and application time of a voltage applied between the pixel electrode and the counter electrode is smaller in the pixel corresponding to the edge portion in the main image portion than in the pixel corresponding to the non-edge portion excluding the edge portion in the main image portion. The "edge portion" used herein forms at least a part of the edge of the main image portion, and means a portion having a predetermined width (for example, a width corresponding to the size of the pixel or a width corresponding to the size of two pixels). The "non-edge portion" used herein means a portion excluding the edge portion in the main image portion, and is usually surrounded by the edge portion.

For example, when no countermeasure is implemented, and the magnitude and application time of a voltage applied between the pixel electrode and the counter electrode are identical between the non-edge portion and the edge portion of the main image portion, an electric field which is generated when a voltage is applied between the pixel electrode and the counter electrode of the pixel corresponding to the edge portion of the main image portion may spread to a part between the pixel electrode and the counter electrode of another pixel (that is, a pixel where the gradation is not changed from the first gradation and no voltage is applied) which is adjacent to the pixel and corresponds to the background image portion, and the gradation of another pixel may be changed. For this reason, an image to be displayed may not be appropriately displayed, for example, an image having an edge wider than an image to be displayed in the display section may be displayed, or the like.

According to the aspect of the invention, a voltage which is applied between the pixel electrode and the counter electrode in the pixel corresponding to the edge portion of the main image portion is smaller in at least one of magnitude and application time than a voltage which is applied between the pixel electrode and the counter electrode in the pixel corresponding to the non-edge portion of the main image portion. Accordingly, it is possible to suppress spread of an electric field, which is generated when a voltage is applied to the pixel electrode and the counter electrode in the pixel corresponding to the edge portion of the main image portion, between the pixel electrode and the counter electrode in the pixel corresponding to the background image portion, and to suppress or prevent changes in the gradation in the pixel corresponding to the background image portion. Therefore, for example, it is possible to suppress or prevent display of an image in which the edge of the main image portion spreads (that is, the occurrence of image spread). As a result, it is possible to display a high-quality image.

As described above, with the method of controlling an electro-optical device according to the aspect of the invention, it is possible to suppress spread of an electric field, which is generated in the pixel corresponding to the edge portion of the main image portion, to the pixel corresponding to the background image portion, and to suppress or prevent changes in the gradation of the pixel corresponding to the background image portion. Therefore, it becomes possible to suppress image spread and to display a high-quality image.

In the method according to the aspect of the invention, the second gradation may have a plurality of gradations, and in the controlling of the driving section, at least one value of the magnitude and application time of the voltage applied between the pixel electrode and the counter electrode in the pixel corresponding to the edge portion may be determined on the basis of a gradation difference between a gradation to be displayed in the pixel corresponding to the edge portion and the first gradation.

With this configuration, the main image portion is displayed as a multi-gradation image having a plurality of gradations. In this configuration, in particular, in the controlling of the driving section, at least one value of the magnitude and application time of a voltage applied between the pixel electrode and the counter electrode in the pixel corresponding to the edge portion is determined on the basis of a gradation difference between a gradation to be displayed in the pixel corresponding to the edge portion and the first gradation. Therefore, it is possible to suppress spread of an electric field, which is generated in the pixel corresponding to the edge portion of the main image portion displayed as a multi-gradation image, to the pixel corresponding to the background image portion, and to suppress or prevent changes in the gradation of the pixel corresponding to the background image portion. As a result, it becomes possible to display a high-quality multi-gradation image.

Another aspect of the invention provides a control device for an electro-optical device. The electro-optical device includes a display section which has a plurality of pixels each having an electro-optical material between a pixel electrode and a counter electrode arranged to be opposite each other, and a driving section which supplies a data potential to the pixel electrode of each of the plurality of pixels. The control device includes a control unit which controls the driving section such that, when an image displayed in the display section is rewritten from a first image displayed in a first gradation to a second image including a background image portion to be displayed in the first gradation and a main image portion to be displayed in a second gradation different from the first gradation, the same potential as the counter electrode is supplied to the pixel electrode of the pixel corresponding to the background image portion as the data potential, and a potential corresponding to the second gradation is supplied to the pixel electrode of the pixel corresponding to the main image portion as the data potential. The control unit controls the driving section such that at least one of the magnitude and application time of a voltage applied between the pixel electrode and the counter electrode is smaller in the pixel corresponding to an edge portion in the main image portion than in the pixel corresponding to a non-edge portion excluding the edge portion in the main image portion.

With the control device for an electro-optical device according to the aspect of the invention, as in the above-described method of controlling an electro-optical device, in the electro-optical device, it is possible to suppress spread of an electric field, which is generated in the pixel corresponding to the edge portion of the main image portion, to the pixel corresponding to the background image portion, and to suppress or prevent changes in the gradation of the pixel corresponding to the background image portion. As a result, it becomes possible to display a high-quality image.

In the control device for an electro-optical device according to the aspect of the invention, various modes which are similar to various modes in the above-described method of controlling an electro-optical device can be used.

Still another aspect of the invention provides an electro-optical device including the above-described control device for an electro-optical device (including various modes).

With the electro-optical device according to the aspect of the invention, the above-described control device for an electro-optical device is provided. Therefore, it is possible to suppress spread of an electric field, which is generated in the pixel corresponding to the edge portion of the main image portion, to the pixel corresponding to the background image portion, and to suppress or prevent changes in the gradation of the pixel corresponding to the background image portion. As a result, it becomes possible to display a high-quality image.

Yet another aspect of the invention provides an electronic apparatus including the above-described electro-optical device (including various modes).

With the electronic apparatus according to the aspect of the invention, the above-described electro-optical device is provided. Therefore, it is possible to realize various electronic apparatuses, such as a wristwatch, an electronic paper, an electronic notebook, a mobile phone, and a portable audio instrument, which can display a high-quality image.

The above and other features and advantages of the invention will become apparent from embodiments described below.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the drawings. In the following embodiments, an electrophoretic display which is an example of an electro-optical device according to the invention will be described.

First Embodiment

An electrophoretic display of a first embodiment will be described with reference to FIGS. 1 to 8.

First, the overall configuration of the electrophoretic display of this embodiment will be described with reference to FIGS. 1 and 2.

Figure 1:
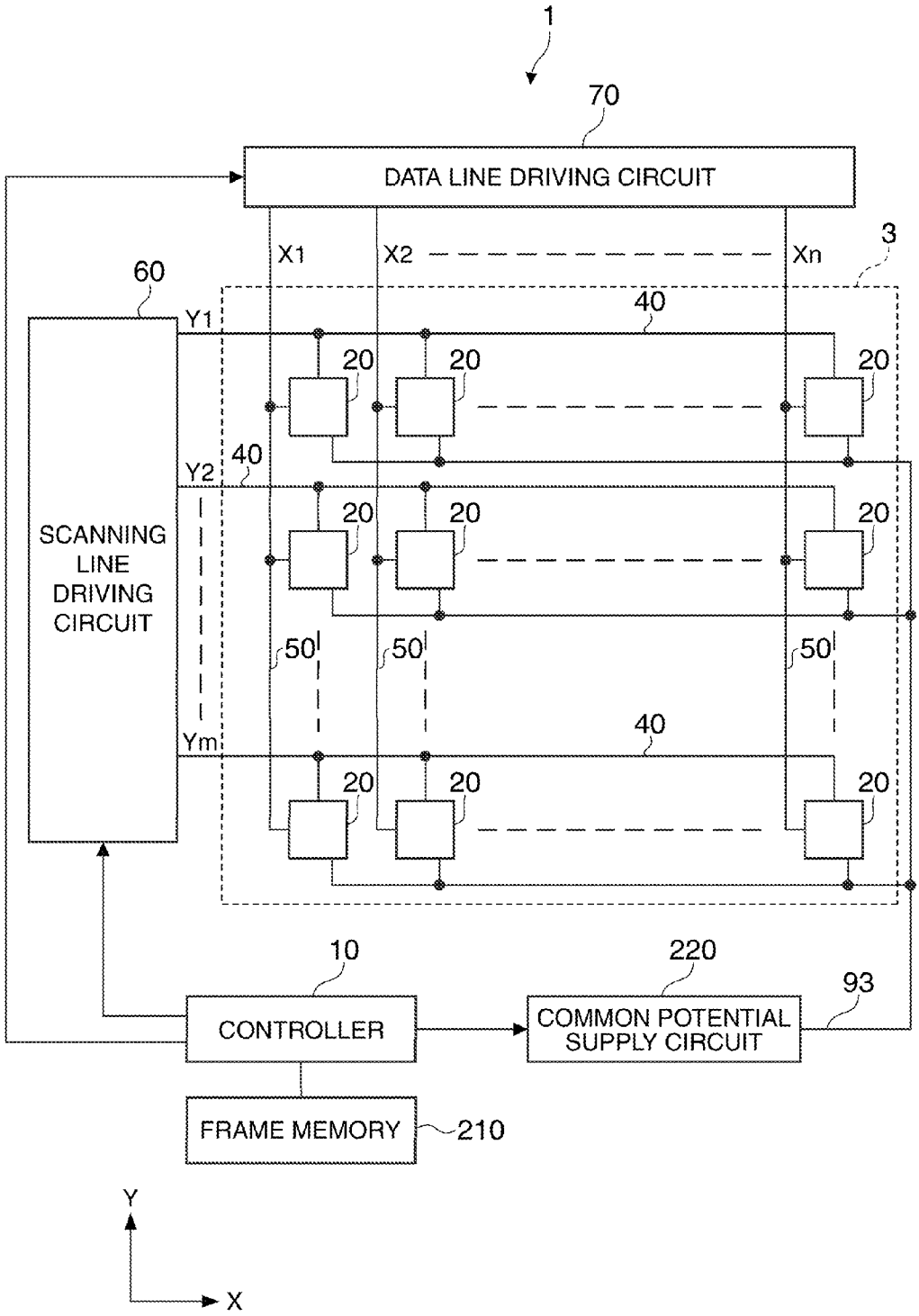
FIG. 1 is a block diagram showing the overall configuration of an electrophoretic display according to a first embodiment.

FIG. 1 is a block diagram showing the overall configuration of the electrophoretic display of this embodiment.

Referring to FIG. 1, an electrophoretic display 1 of this embodiment is an active matrix driving electrophoretic display, and includes a display section 3, a controller 10, a scanning line driving circuit 60, a data line driving circuit 70, a frame memory 210, and a common potential supply circuit 220. The controller 10 is an example of "a control device for an electro-optical device" described in the appended claims. The scanning line driving circuit 60, the data line driving circuit 70, and the common potential supply circuit 220 form an example of "a driving section" described in the appended claims. Hereinafter, the scanning line driving circuit 60, the data line driving circuit 70, and the common potential supply circuit 220 are appropriately collectively referred to as "a driving section".

The display section 3 has m rows×n columns pixels 20 in a matrix (two-dimensional plane). In the display section 3, m scanning lines 40 (that is, scanning lines Y1, Y2, . . . , and Ym) and n data lines 50 (that is, data lines X1, X2, . . . , and Xn) are provided to intersect each other. Specifically, the m scanning lines 40 extend in a row direction (that is, X direction), and the n data lines 50 extend in a column direction (that is, Y direction). The pixels 20 are arranged at the intersections of the m scanning lines 40 and the n data lines 50.

The controller 10 controls the scanning line driving circuit 60, the data line driving circuit 70, and the common potential supply circuit 220. For example, the controller 10 supplies timing signals, such as a clock signal and a start pulse, to the respective circuits.

The scanning line driving circuit 60 sequentially supplies a scanning signal to each of the scanning lines Y1, Y2, . . . , and Ym in a pulsed manner during a predetermined frame period under the control of the controller 10.

The data line driving circuit 70 supplies a data potential to the data lines X1, X2, . . . , and Xn under the control of the controller 10. The data potential is one of a reference potential VM (for example, 0 volt), a high potential VH (for example, +15 volt), and a low potential VL (for example, −15 volt). As described below, in this embodiment, the above-described partial rewrite driving is used.

The frame memory 210 is a memory which can temporarily store image data.

The common potential supply circuit 220 supplies a common potential Vcom (in this embodiment, the same potential as the reference potential VM) to common potential lines 93. The common potential Vcom may be a potential which is different from the reference potential VM in a range in which no voltage is substantially generated between a counter electrode 22 to which the common potential Vcom is supplied and a pixel electrode 21 to which the reference potential VM is supplied.

While various signals are input and output to and from the controller 10, the scanning line driving circuit 60, the data line driving circuit 70, and the common potential supply circuit 220, description of a configuration which is not particularly related to this embodiment will be omitted.

Figure 2:
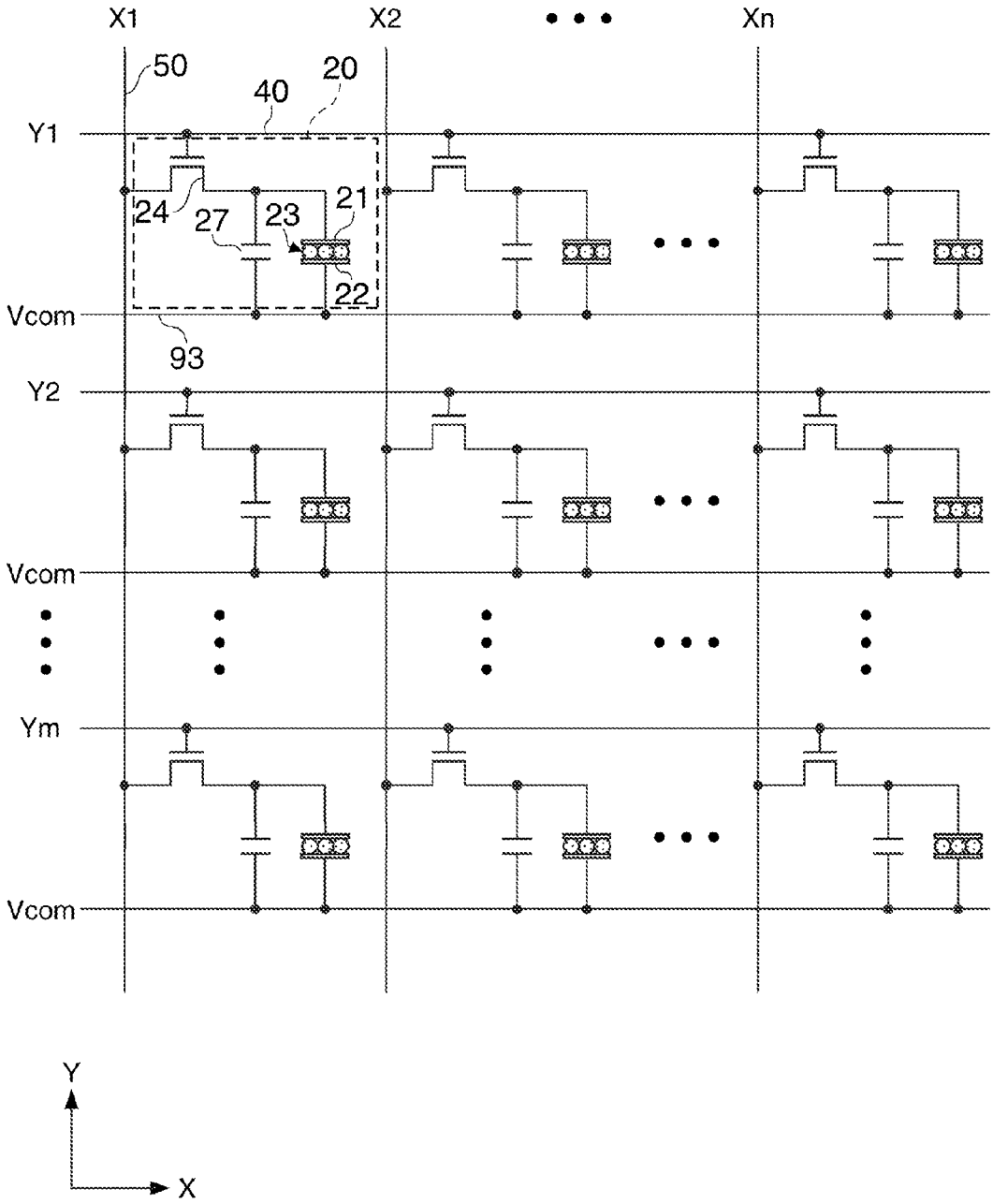
FIG. 2 is an equivalent circuit diagram showing the electrical configuration of a pixel in the electrophoretic display according to the first embodiment.

FIG. 2 is an equivalent circuit diagram showing the electrical configuration of the pixel 20.

Referring to FIG. 2, the pixel 20 includes a pixel switching transistor 24, a pixel electrode 21, a counter electrode 22, an electrophoretic element 23, and a storage capacitor 27.

The pixel switching transistor 24 is, for example, an N-type transistor. The pixel switching transistor 24 has a gate electrically connected to the corresponding scanning line 40, a source electrically connected to the corresponding data line 50, and a drain electrically connected to the pixel electrode 21 and the storage capacitor 27. The pixel switching transistor 24 outputs the data potential, which is supplied from the data line driving circuit 70 (see FIG. 1) through the data line 50, to the pixel electrode 21 and the storage capacitor 27 at the timing based on the scanning signal supplied from the scanning line driving circuit 60 (see FIG. 1) through the scanning line 40 in a pulsed manner.

The pixel electrode 21 is supplied with the data potential from the data line driving circuit 70 through the data line 50 and the pixel switching transistor 24. The pixel electrode 21 is arranged to be opposite the counter electrode 22 through the electrophoretic element 23.

The counter electrode 22 is electrically connected to the corresponding common potential line 93 to which the common potential Vcom is supplied.

The electrophoretic element 23 has a plurality of microcapsules each including electrophoretic particles.

The storage capacitor 27 has a pair of electrodes arranged to be opposite each other through a dielectric film. One electrode is electrically connected to the pixel electrode 21 and the pixel switching transistor 24, and another electrode is electrically connected to the common potential line 93. It is possible to maintain the data potential for a predetermined period of time by the storage capacitor 27.

Next, the basic configuration of the display section in the electrophoretic display of this embodiment will be described with reference to FIG. 3.

Figure 3:
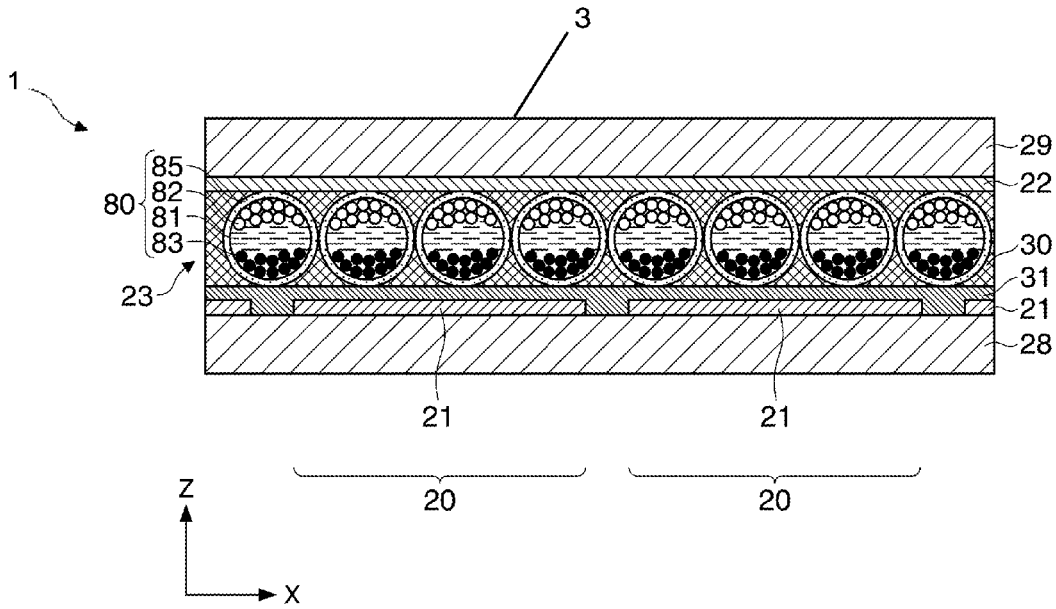
FIG. 3 is a partial sectional view of a display section in the electrophoretic display according to the first embodiment.

FIG. 3 is a partial sectional view of the display section 3 of the electrophoretic display 1.

Referring to FIG. 3, the display section 3 has a configuration in which the electrophoretic element 23 is sandwiched between an element substrate 28 and a counter substrate 29. In this embodiment, description will be provided assuming that an image is displayed on the counter substrate 29 side.

The element substrate 28 is a substrate which is made of, for example, glass, plastic, or the like. Though not shown, a laminated structure of the pixel switching transistor 24, the storage capacitor 27, the scanning line 40, the data line 50, the common potential line 93, and the like described with reference to FIG. 2 is formed on the element substrate 28. A plurality of pixel electrodes 21 are provided in a matrix on the upper layer side of the laminated structure.

The counter substrate 29 is a transparent substrate which is made of, for example, glass, plastic, or the like. On the surface of the counter substrate 29 opposite the element substrate 28, the counter electrode 22 is formed in a solid shape to be opposite a plurality of pixel electrodes 21. The counter electrode 22 is formed of, for example, a transparent conductive material, such as magnesium-silver (MgAg), indium tin oxide (ITO), or indium zinc oxide (IZO).

The electrophoretic element 23 has a plurality of microcapsules 80 each including electrophoretic particles, and is fixed between the element substrate 28 and the counter substrate 29 by a binder 30 and an adhesive layer 31 made of, for example, resin or the like. In the electrophoretic display 1 of this embodiment, during a manufacturing process, an electrophoretic sheet, in which the electrophoretic element 23 is fixed to the counter substrate 29 by the binder 30 is bonded to the element substrate 28, which is separately manufactured and on which the pixel electrodes 21 and the like are formed, by the adhesive layer 31.

One or a plurality of microcapsules 80 are sandwiched between the pixel electrode 21 and the counter electrode 22, and arranged in one pixel 20 (in other words, relative to one pixel electrode 21).

The microcapsules 80 are filled with a dispersion medium 81, a plurality of white particles 82, and a plurality of black particles 83 inside a capsule 85. The microcapsules 80 are formed, for example in a spherical shape having a particle size of about 50 μm.

The capsule 85 functions as a shell of the microcapsule 80 and is formed of acrylic resin, such as polymethylmethacrylate or polyethyl methacrylate, or transmissive polymer resin, such as urea resin, Arabian gum, or gelatin.

The dispersion medium 81 is a medium which disperses the white particles 82 and the black particles 83 in the microcapsule 80 (in other words, in the capsule 85). As the dispersion medium 81, water, alcoholic solvents, such as methanol, ethanol, isopropanol, butanol, octanol, and methyl cellosolve, various esters, such as ethyl acetate, and butyl acetate, ketones, such as acetone, methyl ethyl ketone, and methyl isobutyl ketone, aliphatic hydrocarbons, such as pentane, hexane, and octane, alicyclic hydrocarbons, such as cyclohexane and methylcyclohexane, aromatic hydrocarbons, such as benzene, toluene, and benzenes having a long chain alkyl group, such as xylene, hexyl benzene, heptyl benzen, octylbenzene, nonyl benzene, decyl benzene, undecyl benzene, dodecyl benzene, tridecyl benzene, and tetradecyl benzene, halogenated hydrocarbons, such as methylene chloride, chloroform, carbon tetrachloride, and 1,2-dichloroethane, carboxylate, or other oils may be used alone or in combination. A surfactant may be mixed in the dispersion medium 81.

The white particles 82 are particles (polymer or colloid) which are made of, for example, a white pigment, such as titanium dioxide, Chinese white (zinc oxide), or antimony trioxide, and are, for example, negatively charged.

The black particles 83 are particles (polymer or colloid) which are made of, for example, a black pigment, such as aniline black or carbon black, and are, for example, positively charged.

For this reason, the white particles 82 and the black particles 83 can move in the dispersion medium 81 by an electric field which is generated by a potential difference between the pixel electrode 21 and the counter electrode 22.

If necessary, additives may be added to the pigments. Examples of the additives include an electrolyte, a surfactant, a charge control agent having particles of metal soap, resin, rubber, oil, varnish, or compound, a dispersant, such as a titanium-based coupling agent, an aluminum-based coupling agent, or a silane-based coupling agent, a lubricant, a stabilizer, and the like.

Referring to FIG. 3, when a voltage is applied between the pixel electrode 21 and the counter electrode 22 such that the potential on the counter electrode 22 becomes relatively high, the positively charged black particles 83 are attracted to the pixel electrode 21 side in the microcapsule 80 by a Coulomb's force, and the negatively charged white particles 82 are attracted to the counter electrode 22 side in the microcapsule 80 by a Coulomb's force. As a result, the white particles 82 are cumulated on the display surface side (that is, the counter electrode 22 side) in the microcapsule 80, and the color (that is, white) of the white particles 82 is displayed on the display surface of the display section 3. To the contrary, when a voltage is applied between the pixel electrode 21 and the counter electrode 22 such that a potential on the pixel electrode 21 becomes relatively high, the negatively charged white particles 82 are attracted to the pixel electrode 21 side by a Coulomb's force, and the positively charged black particles 83 are attracted to the counter electrode 22 side by a Coulomb's force. As a result, the black particles 83 are cumulated on the display surface side in the microcapsule 80, and the color (that is, black) of the black particles 83 is displayed on the display surface of the display section 3.

The pigments which are used in the white particles 82 and the black particles 83 may be substituted with pigments of red, green, blue, and the like, and red, green, blue, and the like may be displayed.

Next, a method of controlling an electrophoretic display of this embodiment will be described with reference to FIGS. 4 to 7. Hereinafter, as shown in FIG. 4, a method of controlling the electrophoretic display 1 will be described as to an example where an image displayed in the display section 3 is rewritten from an image P1 to an image P2.

Figure 4:
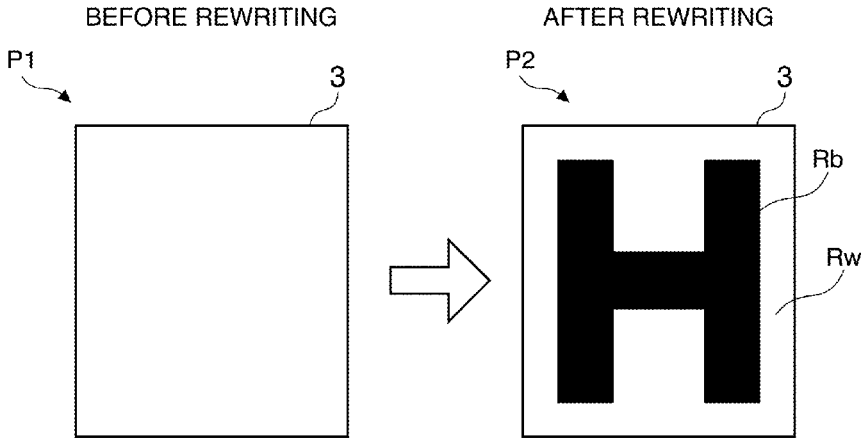
FIG. 4 is a plan view showing an example of images before rewriting and after rewriting.

FIG. 4 is a plan view showing an example of an image P1 before rewriting and an image P2 after rewriting.

As shown in FIG. 4, the image P1 is a full white image with only white. The image P2 is a two-gradation image with two gradations of black and white, and has a background image portion Rw with white and a main image portion Rb with black.

In this embodiment, the above-described partial rewrite driving is used. That is, in this embodiment, when an image displayed in the display section 3 is rewritten from the image P1 to the image P2, in regard to the pixel 20 (that is, the pixel 20 corresponding to the main image portion Rb) where the gradation should be changed from white to black, the high potential VH is applied to the pixel electrode 21 as the data potential. In regard to the pixel 20 (that is, the pixel 20 corresponding to the background image portion Rw) where the gradation is not changed (that is, the gradation should be maintained white), the reference potential VM is supplied to the pixel electrode 21 as the data potential. Accordingly, in the pixel 20 corresponding to the main image portion Rb where the gradation should be changed from white to black, the black particles 83 are cumulated on the display surface side (that is, the counter electrode 22 side), and black is displayed. In the pixel 20 corresponding to the background image portion Rw where the gradation is not changed, the white particles 82 and most or all of the black particles 83 are not moved, and the gradation is maintained white.

Figure 5:
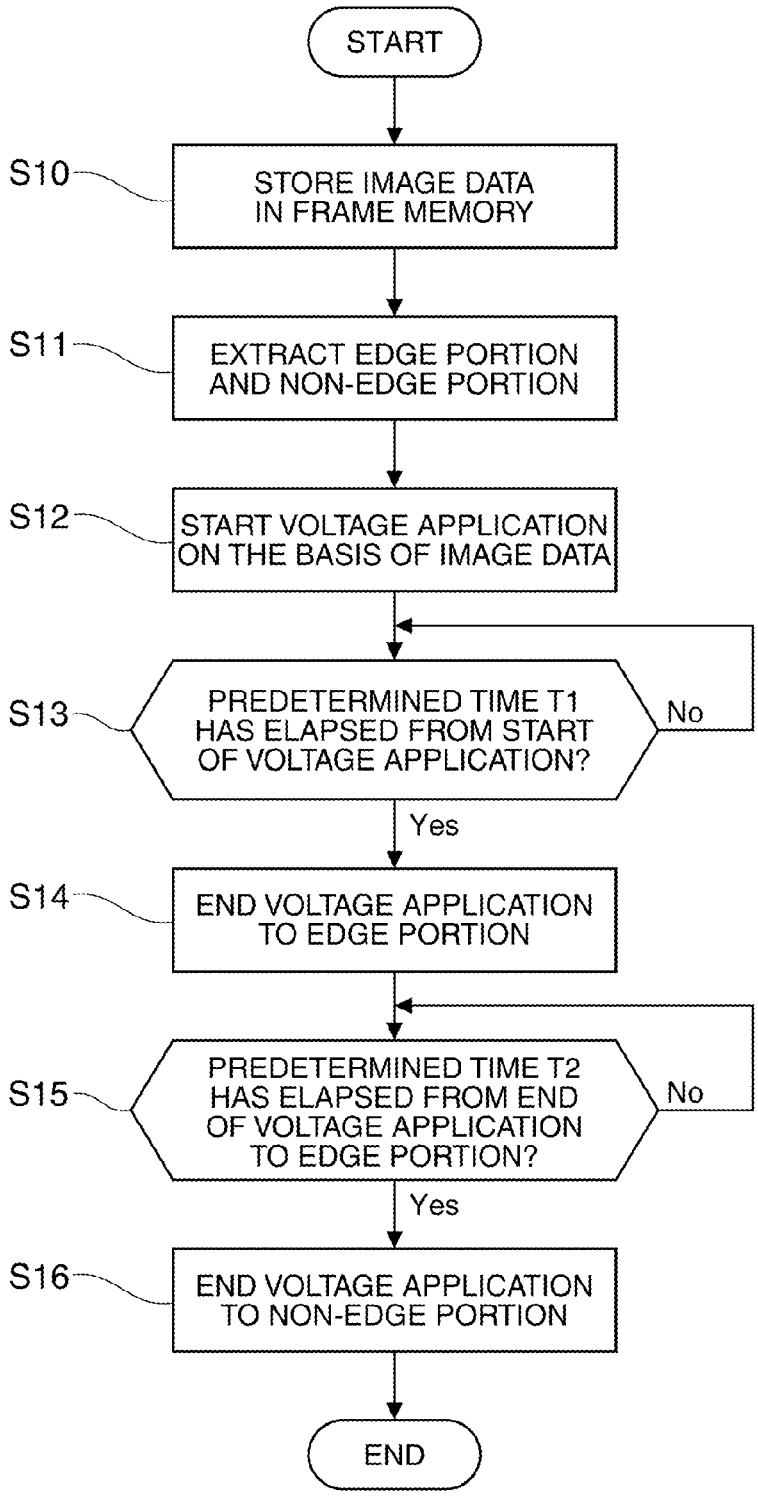
FIG. 5 is a flowchart showing a flow of an image rewrite operation to rewrite an image displayed in a display section in the first embodiment.

FIG. 5 is a flowchart showing a flow of an image rewrite operation to rewrite an image displayed in the display section 3 from the image P1 to the image P2.

Referring to FIG. 5, first, image data is stored in the frame memory 210 (see FIG. 2) (Step S10). The controller 10 temporarily stores, for example, image data of the image P2 supplied from the outside in the frame memory 210. Image data includes image data corresponding to the background image portion Rw and image data corresponding to the main image portion Rb. Of these, image data corresponding to the main image portion Rb includes image data of an edge portion and image data of a non-edge portion described below.

Next, an edge portion and a non-edge portion are extracted from the main image portion Rb of the image P2 (Step S11). That is, the controller 10 sets a portion of the main image portion Rb as an edge portion Rb1 (see FIGS. 6 and 7) on the basis of image data of the image P2 stored in the frame memory 210, and sets a portion excluding the portion set as the edge portion Rb1 in the main image portion Rb as a non-edge portion Rb2 (see FIGS. 6 and 7).

Figure 6:
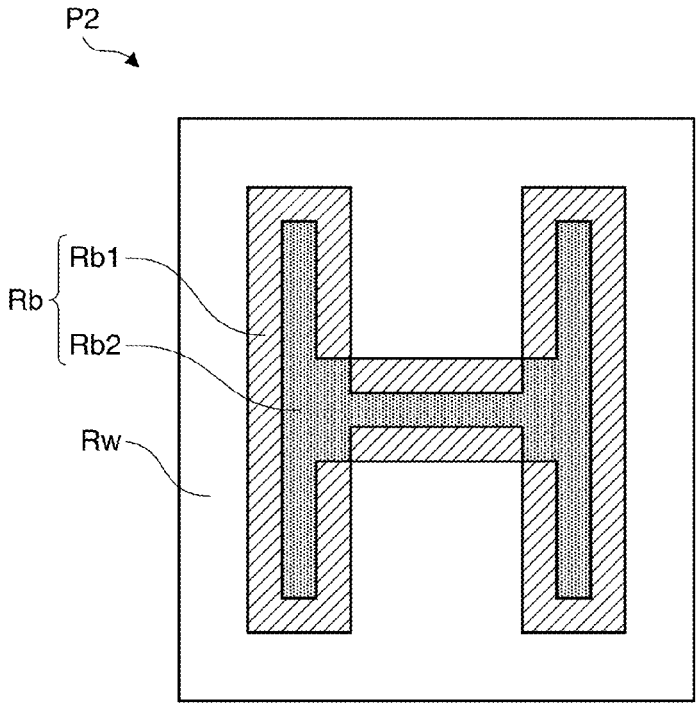
FIG. 6 is a plan view showing an example of edge and non-edge portions which are set in a main image portion after image rewriting.
Figure 7:
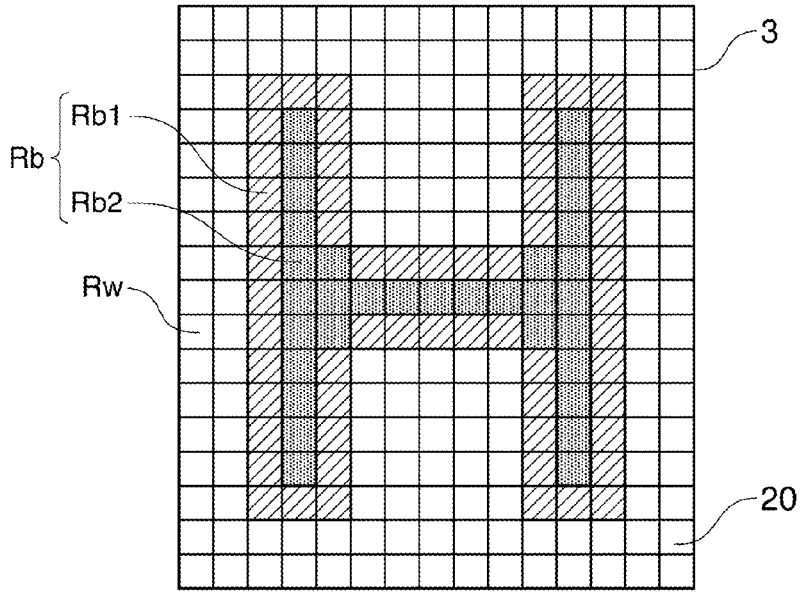
FIG. 7 is a plan view showing an example of the correspondence relation between edge and non-edge portions and a plurality of pixels of a display section.

FIG. 6 is a plan view showing the edge portion Rb1 and the non-edge portion Rb2 which are set in the main image portion Rb of the image P2. FIG. 7 is a plan view showing the correspondence relation between the edge and non-edge portions Rb1 and Rb2 and a plurality of pixels 20 of the display section 3.

As shown in FIGS. 6 and 7, the controller 10 sets a portion for forming the edge of the main image portion Rb as the edge portion Rb1, and sets a portion excluding the edge portion Rb1 in the main image portion Rb as the non-edge portion Rb2. The edge portion Rb1 includes the edge of the main image portion Rb, and has a width corresponding to the size of one pixel (that is, the size of one pixel 20).

Referring to FIG. 5, after the edge portion and the non-edge portion are extracted (Step S11), voltage application to a plurality of pixels 20 starts on the basis of image data (Step S12).

Figure 8:
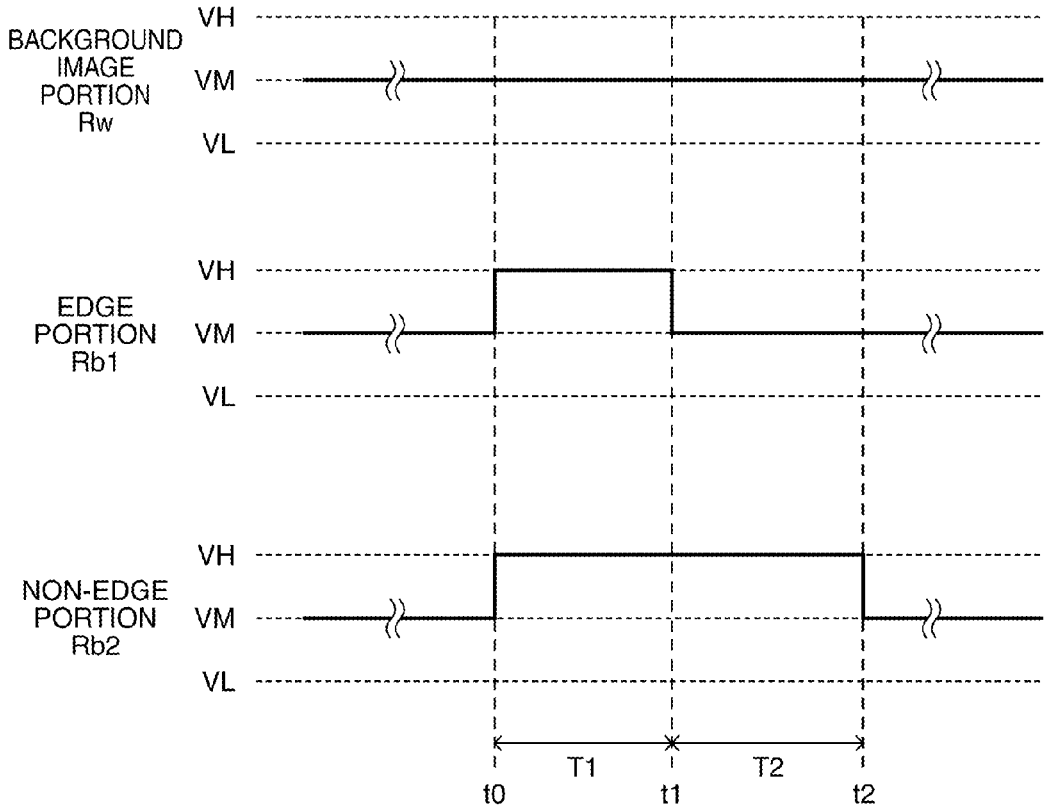
FIG. 8 is a timing chart showing changes in potential of a pixel electrode of a corresponding pixel in each of a background image portion, an edge portion, and a non-edge portion of an image after rewriting in the first embodiment.

That is, as shown in FIG. 8, the controller 10 controls the driving section such that the high potential VH is supplied as the data potential to the pixel electrode 21 of the pixel 20 corresponding to the main image portion Rb (that is, the edge portion Rb1 and the non-edge portion Rb2) where the gradation should be changed from white to black, and the reference voltage VM is supplied as the data potential to the pixel electrode 21 of the pixel 20 corresponding to the background image portion Rw where the gradation is not changed (that is, the gradation should be maintained white). FIG. 8 is a timing chart showing changes in potential (in other words, changes in data potential to be supplied) on the pixel electrode 21 of the corresponding pixel 20 in each of the background image portion Rw, the edge portion Rb1, and the non-edge portion Rb2 of the image P2. In FIG. 8, the time at which the high potential VH starts to be supplied to the pixel electrode 21 of the pixel 20 corresponding to the main image portion Rb (that is, the edge portion Rb1 and the non-edge portion Rb2) as the data potential is the time to.

Referring to FIG. 5, after voltage application to a plurality of pixels 20 has started on the basis of image data (Step S12), it is determined whether or not a predetermined time T1 has elapsed from the start of voltage application (Step S13). That is, the controller 10 determines whether or not the predetermined time T1 has elapsed after the high potential VH has started to be supplied to the pixel electrode 21 of the pixel 20 corresponding to the main image portion Rb (that is, the edge portion Rb1 and the non-edge portion Rb2) as the data potential (that is, from the time t0 in FIG. 8).

When it is determined that the predetermined time T1 has not elapsed (Step S13: No), voltage application to a plurality of pixels 20 continues on the basis of image data.

When it is determined that the predetermined time T1 has elapsed (Step S13: Yes), the controller 10 ends voltage application of the edge portion Rb1 (Step S14).

That is, as shown in FIG. 8, the controller 10 switches the data potential supplied to the edge portion Rb1 from the high potential VH to the reference potential VM at the time t1 when the predetermined time T1 has elapsed after the high potential VH has started to be supplied to the pixel electrode 21 of the pixel 20 corresponding to the main image portion Rb (that is, the edge portion Rb1 and the non-edge portion Rb2) as the data potential (that is, from the time t0 in FIG. 8). Accordingly, little or no voltage is applied between the pixel electrode 21 and the counter electrode 22 in the pixel 20 corresponding to the edge portion Rb1. At this time, voltage application to the non-edge portion Rb2 continues, that is, the data potential which is supplied to the pixel electrode 21 of the pixel 20 corresponding to the non-edge portion Rb2 is maintained at the high potential VH.

Next, referring to FIG. 5, it is determined whether or not a predetermined time T2 has elapsed from the end of voltage application of the edge portion Rb1 (Step S15). That is, the controller 10 determines whether or not the predetermined time T2 has elapsed from the end of voltage application of the edge portion Rb1 (that is, from the time t1 in FIG. 8).

When it is determined that the predetermined time T2 has not elapsed (Step S15: No), voltage application of the non-edge portion Rb2 continues.

When it is determined that the predetermined time T2 has elapsed (Step S15: Yes), the controller 10 ends voltage application of the non-edge portion Rb2 (Step S16).

That is, as shown in FIG. 8, the controller 10 switches the data potential supplied to the non-edge portion Rb2 from the high potential VH to the reference potential VM at the time t2 when the predetermined time T2 has elapsed from the time t1 at which voltage application of the edge portion Rb1 has ended (in other words, after the data potential supplied to the edge portion Rb1 has been switched from the high potential VH to the reference potential VM). Accordingly, little or no voltage is applied between the pixel electrode 21 and the counter electrode 22 in the pixel 20 corresponding to the non-edge portion Rb2.

As described above, in this embodiment, when an image displayed in the display section 3 is rewritten from the image P1 to the image P2, the high potential VH is supplied to the pixel electrode 21 of the pixel 20 corresponding to the edge portion Rb1 of the main image portion Rb as the data potential for the predetermined time T1, and the high potential VH is supplied to the pixel electrode 21 of the pixel 20 corresponding to the non-edge portion Rb2 of the main image portion Rb as the data potential for the total time of the predetermined time T1 and the predetermined time T2.

That is, in this embodiment, in particular, the controller 10 controls the driving section such that the application time for which a voltage is applied between the pixel electrode 21 and the counter electrode 22 (that is, the time for which the high potential VH is supplied to the pixel electrode 21 as the data potential) is smaller in the pixel 20 corresponding to the edge portion Rb1 of the main image portion Rb than in the pixel 20 corresponding to the non-edge portion Rb2 of the main image portion Rb.

For example, when no countermeasure is implemented, and the application time for which a voltage is applied between the pixel electrode 21 and the counter electrode 22 is identical between the edge portion Rb1 and the non-edge portion Rb2 of the main image portion Rb, for example, when a voltage is applied between the pixel electrode 21 and the counter electrode 22 in the pixel 20 corresponding to the edge portion Rb1 and the non-edge portion Rb2 for the total time of the predetermined time T1 and the predetermined time T2, an electric field which is generated when a voltage is applied between the pixel electrode 21 and the counter electrode 22 in one pixel 20 corresponding to the edge portion Rb1 of the main image portion Rb may spread to a part between the pixel electrode 21 and the counter electrode 22 in another pixel 20 (that is, the pixel 20 where the gradation is not changed from white and no voltage is applied) which is adjacent to one pixel 20 and corresponds to the background image portion Rw, and the gradation of another pixel 20 may be changed. For this reason, an image to be displayed may not be appropriately displayed, for example, an image having an edge wider than an image to be displayed in the display section 3 may be displayed, or the like.

According to this embodiment, the application time (in this embodiment, the time T1) for which a voltage is applied between the pixel electrode 21 and the counter electrode 22 in the pixel 20 corresponding to the edge portion Rb1 of the main image portion Rb is smaller (that is, shorter) than the application time (in this embodiment, the total time of the time T1 and the time T2) for which a voltage is applied between the pixel electrode 21 and the counter electrode 22 in the pixel 20 corresponding to the non-edge portion Rb2 of the main image portion Rb. Accordingly, it is possible to suppress spread of an electric field, which is generated when a voltage is applied between the pixel electrode 21 and the counter electrode 22 in the pixel 20 corresponding to the edge portion Rb1 of the main image portion Rb, between the pixel electrode 21 and the counter electrode 22 in the pixel 20 corresponding to the background image portion Rw, thereby suppressing or preventing changes in the gradation of the pixel 20 corresponding to the background image portion Rw. Therefore, it is possible to suppress or prevent display of an image in which the edge of the main image portion Rb spreads (that is, the occurrence of image spread). As a result, it is possible to display a high-quality image.

As described above, according to this embodiment, it is possible to suppress spread of an electric field, which is generated in the pixel 20 corresponding to the edge portion Rb1 of the main image portion Rb, to the pixel corresponding to the background image portion Rw, and to suppress or prevent changes in the gradation of the pixel corresponding to the background image portion Rw. Therefore, it becomes possible to suppress image spread and to display a high-quality image.

Although in this embodiment, an example has been described where the extraction of the edge portion and the non-edge portion from the main image portion Rb of the image P2 (Step S11) is performed by the controller 10, the extraction of the edge portion and the non-edge portion may be performed by an external apparatus, such as a computer, which supplies image data of the image P2 to the electrophoretic display 1. That is, voltage application to a plurality of pixels 20 may be performed on the basis of image data of the edge portion Rb1 and the non-edge portion Rb2 set by the external apparatus.

Second Embodiment

An electrophoretic display of a second embodiment will be described with reference to FIGS. 9 and 10. Hereinafter, as in the first embodiment, the electrophoretic display of the second embodiment will be described as to an example where an image displayed in the display section 3 is rewritten from the image P1 to the image P2 shown in FIG. 4.

The electrophoretic display of the second embodiment is different from the electrophoretic display 1 of the first embodiment in that, when an image displayed in the display section 3 is rewritten from the image P1 to the image P2, a voltage which is applied between the pixel electrode 21 and the counter electrode 22 in the pixel 20 corresponding to the edge portion Rb1 is lower than a voltage which is applied between the pixel electrode 21 and the counter electrode 22 in the pixel 20 corresponding to the non-edge portion Rb2. Other parts are the same as those in the electrophoretic display 1 of the first embodiment.

Figure 9:
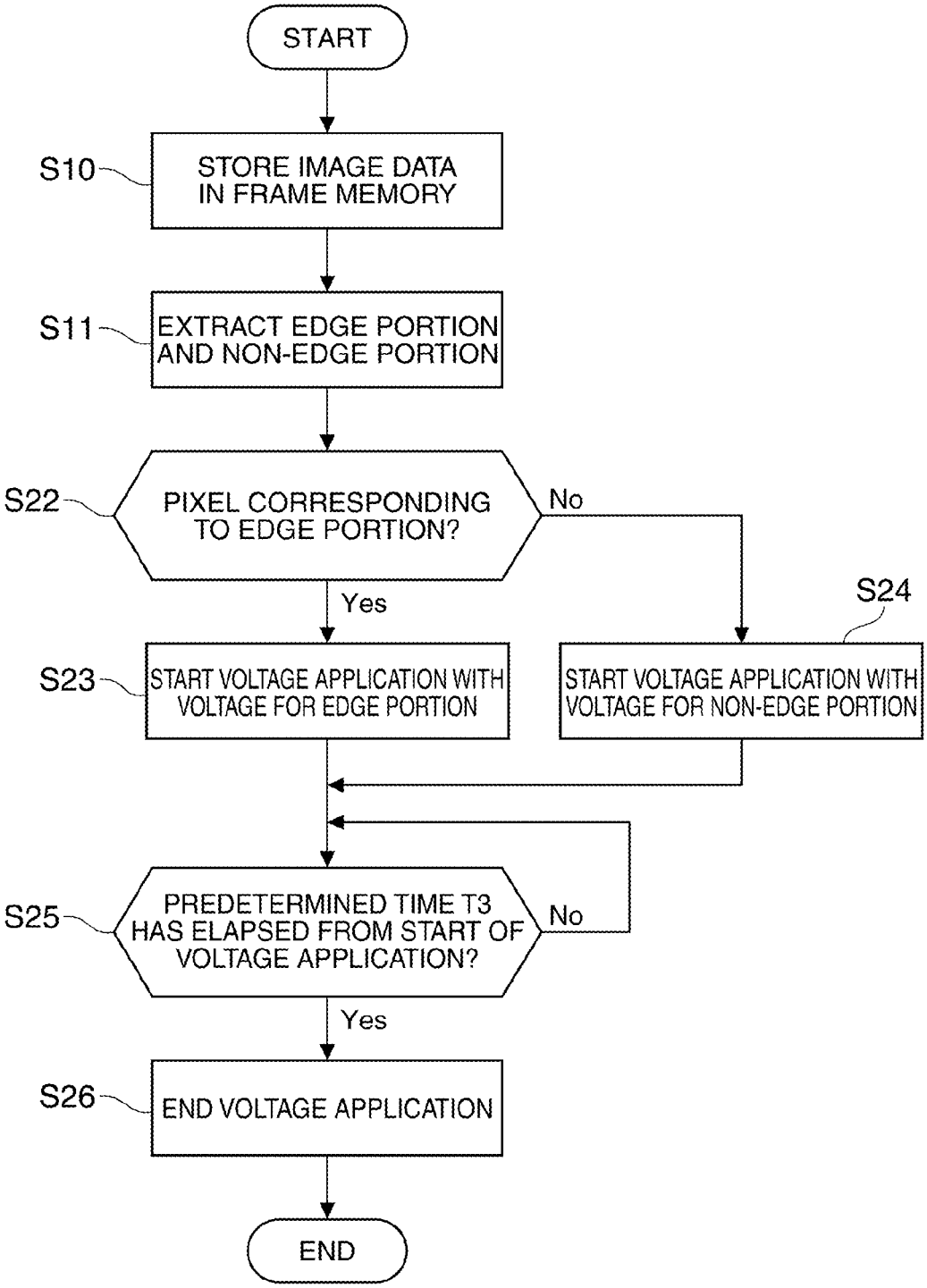
FIG. 9 is a flowchart showing a flow of an image rewrite operation to rewrite an image displayed in a display section in a second embodiment.

FIG. 9 is a flowchart showing a flow of an image rewrite operation to rewrite an image displayed in the display section 3 from the image P1 to the image P2 in the second embodiment. In FIG. 9, the same steps as the steps in the first embodiment described with reference to FIG. 5 are represented by the same step numbers, and description thereof will not be repeated.

Referring to FIG. 9, first, image data is stored in the frame memory 210 (Step S10), and the edge portion Rb1 and the non-edge portion Rb2 are extracted from the main image portion Rb of the image P2 (Step S11).

Next, it is determined whether or not the pixel 20 to which a voltage should be applied (that is, the pixel 20 which corresponds to the main image portion Rb and in which the gradation should be changed from white to black), specifically, the pixel 20 to which a voltage is now applied is the pixel 20 corresponding to the edge portion Rb1 (Step S22). That is, the controller 10 determines whether the pixel 20 to which a voltage is now applied corresponds to the edge portion Rb1 or the non-edge portion Rb2 (Step S22).

When it is determined that the pixel 20 to which a voltage is now applied is the pixel 20 corresponding to the edge portion Rb1 (Step S22: Yes), voltage application starts with a voltage for an edge portion (Step S23). When it is determined that the pixel 20 to which a voltage is now applied is not the pixel 20 corresponding to the edge portion Rb1 (that is, the pixel 20 corresponding to the non-edge portion Rb2) (Step S22: No), voltage application starts with a voltage for a non-edge portion (Step S24).

Figure 10:
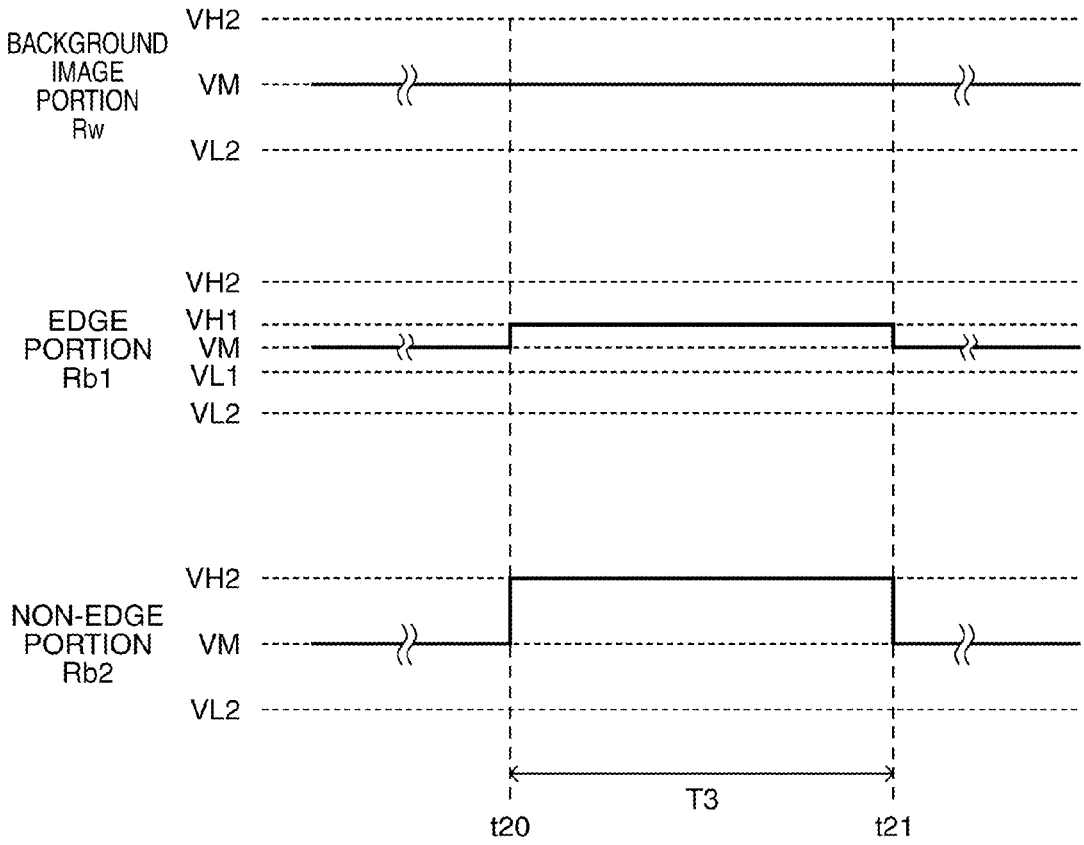
FIG. 10 is a timing chart showing changes in potential of a pixel electrode of a corresponding pixel in each of a background image portion, an edge portion, and a non-edge portion of an image after rewriting in the second embodiment.

That is, as shown in FIG. 10, the controller 10 controls the driving section such that a high potential VH1 for an edge portion is supplied to the pixel electrode 21 of the pixel 20 corresponding to the edge portion Rb1 as the data potential, and a high potential VH2 for a non-edge portion is supplied to the pixel electrode 21 of the pixel 20 corresponding to the non-edge portion Rb2. FIG. 10 is a timing chart showing changes in potential on the pixel electrode 21 of the corresponding pixel 20 in each of the background image portion Rw, the edge portion Rb1, and the non-edge portion Rb2 of the image P2 in the second embodiment (in other words, changes in the data potential to be supplied). In FIG. 10, the time at which the high potential VH1 for an edge portion or the high potential VH2 for a non-edge portion starts to be supplied to the pixel electrode 21 of the pixel 20 corresponding to the main image portion Rb (that is, the edge portion Rb1 and the non-edge portion Rb2) as the data potential is the time t20. The high potential VH1 for an edge portion and the high potential VH2 for a non-edge portion are higher than the reference potential VM. The high potential VH1 for an edge portion is lower than the high potential VH2 for a non-edge portion. That is, a voltage for an edge portion which is applied between the pixel electrode 21 and the counter electrode 22 in the pixel 20 corresponding to the edge portion Rb1 is lower than a voltage for a non-edge portion which is applied between the pixel electrode 21 and the counter electrode 22 in the pixel 20 corresponding to the non-edge portion Rb2.

Referring to FIG. 9, after voltage application to the pixel 20 corresponding to the main image portion Rb (that is, the edge portion Rb1 and the non-edge portion Rb2) has started (Step S23 and S24), it is determined whether or not a predetermined time T3 has elapsed from the start of voltage application (Step S25). That is, the controller 10 determines whether or not the predetermined time T3 has elapsed after the high potential VH1 for an edge portion and the high potential VH2 for a non-edge portion have started to be supplied to the pixel electrode 21 of the pixel 20 corresponding to the main image portion Rb (that is, the edge portion Rb1 and the non-edge portion Rb2) as the data potential (that is, from the time t20 in FIG. 10).

When it is determined that the predetermined time T3 has not elapsed (Step S25: No), voltage application to the pixel 20 corresponding to the main image portion Rb (that is, the edge portion Rb1 and the non-edge portion Rb2) continues.

When it is determined that the predetermined time T3 has elapsed (Step S25: Yes), the controller 10 ends voltage application to the pixel 20 corresponding to the main image portion Rb (that is, the edge portion Rb1 and the non-edge portion Rb2) (Step S26).

That is, as shown in FIG. 10, at the time t21 at which the predetermined time T3 has elapsed after the high potential VH1 for an edge portion and the high potential VH2 for a non-edge portion have started to be supplied to the pixel electrode 21 of the pixel 20 corresponding to the main image portion Rb (that is, the edge portion Rb1 and the non-edge portion Rb2) (that is, from the time t20 in FIG. 10), the controller 10 switches the data potential supplied to the edge portion Rb1 from the high potential VH1 for an edge portion to the reference potential VM, and also switches the data potential supplied to the non-edge portion Rb2 from the high potential VH2 for a non-edge portion to the reference potential VM. Accordingly, little or no voltage is applied between the pixel electrode 21 and the counter electrode 22 in the pixel 20 corresponding to the edge portion Rb1.

As described above, in this embodiment, when an image displayed in the display section 3 is rewritten from the image P1 to the image P2, the high potential VH1 for an edge portion lower than the high potential VH2 for a non-edge portion is supplied to the pixel electrode 21 of the pixel 20 corresponding to the edge portion Rb1 of the main image portion Rb as the data potential for the predetermined time T3, and the high potential VH2 for a non-edge portion is supplied to the pixel electrode 21 of the pixel 20 corresponding to the non-edge portion Rb2 of the main image portion Rb as the data potential for the predetermined time T3.

That is, in this embodiment, in particular, the controller 10 controls the driving section such that the magnitude of a voltage applied between the pixel electrode 21 and the counter electrode 22 is smaller in the pixel 20 corresponding to the edge portion Rb1 of the main image portion Rb than in the pixel 20 corresponding to the non-edge portion Rb2 of the main image portion Rb.

Accordingly, when no countermeasure is implemented, and the magnitude of a voltage applied between the pixel electrode 21 and the counter electrode 22 is identical between the edge portion Rb1 and the non-edge portion Rb2 of the main image portion Rb, for example, between the pixel electrode 21 and the counter electrode 22 in the pixel 20 corresponding to either the edge portion Rb1 or the non-edge portion Rb2, compared to a case where the a potential difference (that is, voltage) between the high potential VH2 for a non-edge portion and the reference potential VM is applied for the predetermined time T3, it is possible to suppress or prevent changes in the gradation of the pixel 20 corresponding to the background image portion Rw because an electric field which is generated when a voltage is applied between the pixel electrode 21 and the counter electrode 22 in the pixel 20 corresponding to the edge portion Rb1 of the main image portion Rb spreads between the pixel electrode 21 and the counter electrode 22 in the pixel corresponding to the background image portion Rw. Therefore, it is possible to suppress or prevent display of an image in which the edge of the main image portion Rb spreads. As a result, it is possible to display a high-quality image.

Third Embodiment

An electrophoretic display of a third embodiment will be described with reference to FIGS. 11 and 12. Hereinafter, the electrophoretic display of the third embodiment will be described as to an example where an image displayed in the display section 3 is rewritten from a full white image with only white to a four-gradation image having a background image portion Rw with white and a main image portion Rb with black, dark grey, and light grey. In this embodiment, the gradation values of black, dark grey, light grey, and white are respectively set to "1", "2", "3", and "4". That is, the gradation value of black is "1", the gradation value of dark grey is "2", the gradation value of light grey is "3", and the gradation value of white is "4".

Figure 11:
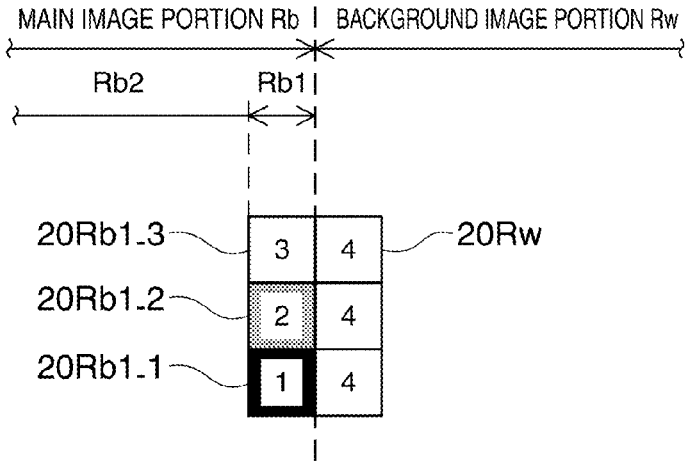
FIG. 11 is a schematic view showing an example of a gradation of a pixel corresponding to a part of a four-gradation image after rewriting.

FIG. 11 is a schematic view showing an example of the gradation of a pixel 20 corresponding to a part of a four-gradation image after rewriting.

Referring to FIG. 11, a pixel 20Rw is a pixel 20 which corresponds to the background image portion Rw, and in which, when an image displayed in the display section 3 is rewritten from a full white image to a four-gradation image, the gradation is not changed from white (that is, the gradation whose gradation value is "4") (that is, the gradation should be maintained white). A pixel 20Rb1_1 is a pixel 20, in which, when an image displayed in the display section 3 is rewritten from a full white image to a four-gradation image, the gradation should be changed from white to black (that is, the gradation whose gradation value is "1"), from among the pixels 20 corresponding to the edge portion Rb1. A pixel 20Rb1_2 is a pixel 20, in which, when an image displayed in the display section 3 is rewritten from a full white image to a four-gradation image, the gradation should be changed from white to dark grey (that is, the gradation whose gradation value is "2"), from among the pixels 20 corresponding to the edge portion Rb1. A pixel 20Rb1_3 is a pixel 20, in which, when an image displayed in the display section 3 is rewritten from a full white image to a four-gradation image, the gradation should be changed from white to light grey (that is, the gradation whose gradation value is "3"), from among the pixels 20 corresponding to the edge portion Rb1.

Basically, the electrophoretic display of the third embodiment substantially has the same configuration as the electrophoretic display of the first embodiment. The controller 10 controls the driving section such that the time (hereinafter, appropriately referred to as "voltage application time") for which a voltage is applied between the pixel electrode 21 and the counter electrode 22 is smaller in the pixel 20 corresponding to the edge portion Rb1 of the main image portion Rb than in the pixel 20 corresponding to the non-edge portion Rb2 of the main image portion Rb.

In this embodiment, in particular, the voltage application time for which a voltage is applied between the pixel electrode 21 and the counter electrode 22 in the pixel 20 corresponding to the edge portion Rb1 is determined on the basis of a gradation difference (that is, a difference in the gradation value) between a gradation (that is, black, dark grey, and light grey) to be displayed in the pixel 20 corresponding to the edge portion Rb1 and the gradation (that is, white) of the background image portion Rw. Specifically, the controller 10 has a reference table (that is, a look-up table) 910 shown in FIG. 12 in which a gradation difference and a voltage application time are associated with each other, and determines the voltage application time relative to the pixel 20 corresponding to the edge portion Rb1 with reference to the reference table 910.

Figures 12, 13:
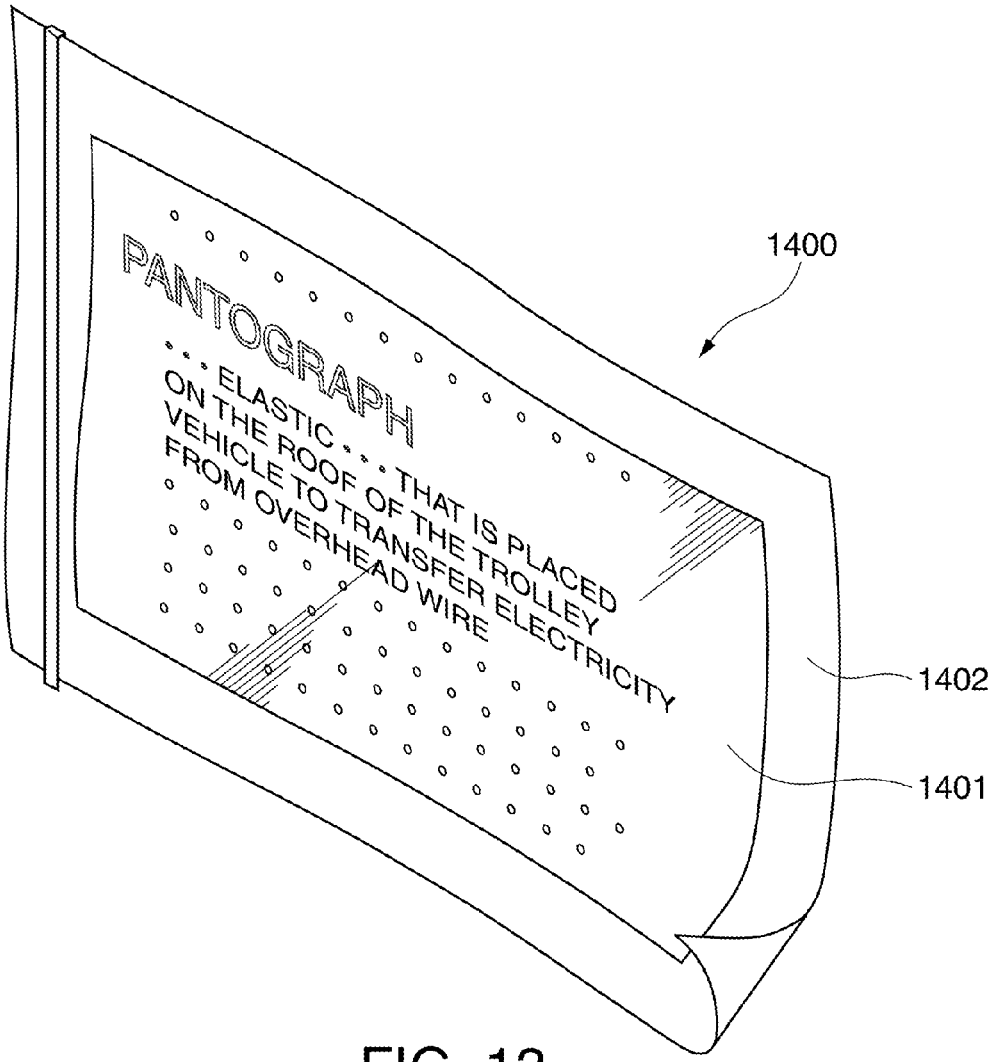
FIG. 12 is a conceptual diagram conceptually showing a reference table, in which a gradation difference and a voltage application time are associated with each other, according to a third embodiment.
FIG. 13 is a perspective view showing the configuration of an electronic paper which is an example of an electronic apparatus, to which an electro-optical device is applied.

FIG. 12 is a conceptual diagram conceptually showing a reference table, in which a gradation difference and a voltage application time are associated with each other, according to this embodiment.

As shown in FIG. 12, in the reference table 910, the time T11 is set as the voltage application time when the gradation difference is "1", the time T12 which is shorter than the time T11 is set as the voltage application time when the gradation difference is "2", and the time T13 which is shorter than the time T12 is set as the voltage application time when the gradation difference is "3". That is, in the reference table 910, the gradation difference and the voltage application time are associated with each other such that the larger the gradation difference, the shorter the voltage application time. Accordingly, the controller 10 controls the driving section such that the larger the gradation difference between a gradation to be displayed in the pixel 20 corresponding to the edge portion Rb1 and the gradation (that is, white) of the background image portion Rw, the shorter the voltage application time for which a voltage is applied between the pixel electrode 21 and the counter electrode 22 in the pixel 20 corresponding to the edge portion Rb1.

Therefore, it is possible to suppress spread of an electric field, which is generated in the pixel 20 (that is, the pixels 20Rb1_1, 20Rb1_2, and 20Rb1_3) corresponding to the edge portion Rb1 of the main image portion Rb displayed as a three-gradation image, to the pixel 20 (that is, the pixel 20Rw) corresponding to the background image portion Rw, and to suppress or prevent changes in the gradation of the pixel 20 corresponding to the background image portion Rw.

Specifically, if the main image portion Rb has a plurality of gradations, when rewriting of the main image portion Rb, voltage application for a long time is necessary for rewriting in the pixels 20 with a large gradation difference of the background image portion Rw and the main image portion Rb. For this reason, an electric field in the pixel 20 corresponding to a portion with a large gradation difference in the edge portion Rb1 of the main image portion Rb is likely to spread to the pixel 20 of the background image portion Rw. In regard to this problem, as in this embodiment, control is performed such that the voltage application time is shortened in the pixel 20 corresponding to a portion with a large gradation difference in the edge portion Rb1, thereby suppressing spread of an electric field uniformly without depending on the gradation difference in the background image portion Rw and the main image portion Rb (edge portion Rb1). Therefore, it becomes possible to display a high-quality multi-gradation image.

The magnitude of the voltage which is applied between the pixel electrode 21 and the counter electrode 22 in the pixel 20 corresponding to the edge portion Rb1 may be determined on the basis of the gradation difference (that is, the difference in the gradation value) between the gradation (that is, black, dark grey, and light grey) to be displayed in the pixel 20 corresponding to the edge portion Rb1 and the gradation (that is, white) of the background image portion Rw. Specifically, the controller 10 may have a reference table in which a gradation difference and an application voltage are associated with each other such that the larger the gradation difference, the lower the application voltage, and may determine the magnitude of a voltage, which is applied between the pixel electrode 21 and the counter electrode 22 in the pixel 20 corresponding to the edge portion Rb1, with reference to the reference table.

Electronic Apparatus

Next, an electronic apparatus to which the above-described electrophoretic display is applied will be described with reference to FIGS. 13 and 14. The following description will be provided as to an example where the above-described electrophoretic display is applied to an electronic paper and an electronic notebook.

FIG. 13 is a perspective view showing the configuration of an electronic paper 1400.

As shown in FIG. 13, the electronic paper 1400 includes the electrophoretic display of the foregoing embodiment as a display section 1401. The electronic paper 1400 is flexible, and includes a main body 1402 which is formed of a rewritable sheet having the same texture and plasticity as paper.

Figure 14:
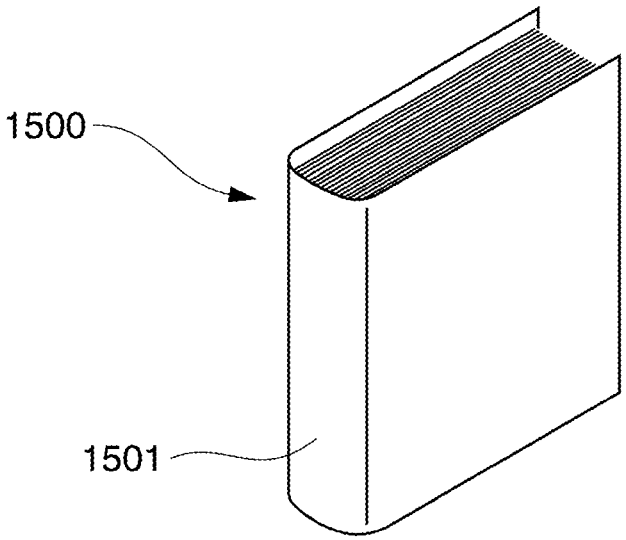
FIG. 14 is a perspective view showing the configuration of an electronic notebook which is an example of an electronic apparatus, to which an electro-optical device is applied.

FIG. 14 is a perspective view showing the configuration of an electronic notebook 1500.

As shown in FIG. 14, the electronic notebook 1500 is configured such that a plurality of electronic papers 1400 shown in FIG. 13 are bundled and held by a cover 1501. The cover 1501 includes a display data input unit (not shown) which inputs, for example, display data sent from an external apparatus. This allows changing or updating the display content in accordance with display data in a state where the electronic papers are bundled.

The electronic paper 1400 and the electronic notebook 1500 include the electrophoretic display of the foregoing embodiment, thereby performing high-quality image display.

The electrophoretic display of the foregoing embodiment may be applied to a display section of an electronic apparatus, such as a wristwatch, a mobile phone, or a portable audio instrument.

The invention may also be applied to a display device which uses an electrogranular fluid, in addition to the electrophoretic display.

The invention is not limited to the foregoing embodiments, and may be appropriately changed without departing from the subject matter or spirit of the invention described in the appended claims and the specification. A method of controlling an electro-optical device, a control device for an electro-optical device, an electro-optical device, and an electronic apparatus accompanied by the changes still fall within the technical scope of the invention.

Modification 1

Although in the foregoing embodiments, a case has been described where the black main image portion Rb is displayed in the white background image portion Rw, the invention is not limited thereto, and a white main image portion may be displayed in a black background image portion. In this case, in order to rewrite a black pixel 20 to white, a potential (for example, the low potential VL) lower than the potential (for example, the reference potential VM) of the counter electrode 22 is supplied to the pixel electrode 21. When the magnitude of the application voltage to the pixel 20 of the edge portion is controlled so as to suppress spread of an electric field from the pixel 20 of the edge portion to an adjacent pixel 20, the controller 10 controls the driving section such that a low potential VL1 for an edge portion is supplied to the pixel electrode 21 of the pixel 20 corresponding to the edge portion of the main image portion as the data potential, and a low potential VL2 for a non-edge portion is applied to the pixel electrode 21 of the pixel 20 corresponding to the non-edge portion as the data potential. The low potential VL1 for an edge portion is a potential which is lower than the reference potential VM, and the low potential VL2 for a non-edge portion is a potential which is lower than the low potential VL1 for an edge portion. When this happens, even in a case where a white main image portion is displayed in a black background image portion, it is possible to suppress or prevent changes in the gradation of the pixel 20 corresponding to the background image portion because an electric field which is generated when a voltage is applied between the pixel electrode 21 and the counter electrode 22 in the pixel 20 corresponding to the edge portion spreads between the pixel electrode 21 and the counter electrode 22 in the pixel 20 corresponding to the background image portion.

Modification 2

Although in the first and third embodiments, a case has been described where the width of a single voltage pulse supplied to the pixel of the edge portion Rb1 becomes relatively small so that the voltage application time in the pixel 20 of the edge portion Rb1 becomes shorter than the voltage application time in the pixel 20 of the non-edge portion Rb2, the invention is not limited thereto. As another example, rewriting from the image P1 to the image P2 may be performed using a plurality of frame periods, and the number of frame periods in which a voltage is applied to the pixel 20 of the edge portion Rb1 may become smaller than the number of frame periods in which a voltage is applied to the pixel 20 of the non-edge portion Rb2. The frame period means a period in which all the scanning lines 40 in the display section 3 are selected once. Even in this case, it is possible to make the voltage application time in the pixel 20 of the edge portion Rb1 shorter than the voltage application time in the pixel 20 of the non-edge portion Rb2.

Modification 3

Although in the foregoing embodiments and modifications, an example where the white particles 82 are negatively charged and the black particles 83 are positively charged has been described, the white particles 82 may be positively charged and the black particles 83 may be negatively charged. The electrophoretic element 23 is not limited to the configuration in which the microcapsules 80 are provided, and may have a configuration in which an electrophoretic dispersion medium and electrophoretic particles are provided in a space partitioned by a partition wall. Although an example where the electro-optical device has the electrophoretic element 23 has been described, the invention is not limited thereto. Any electro-optical device may be used insofar as the electro-optical device includes a display element in which an electric field when a voltage is applied to a certain pixel can affect an adjacent pixel. For example, an electro-optical device using an electrogranular fluid may be used.

The entire disclosure of Japanese Patent Application No. 2011-088214, filed Apr. 12, 2011 is expressly incorporated by reference herein.

What is claimed is:

1. A method of controlling an electro-optical device including a display section which has a plurality of pixels each having an electro-optical material between a pixel electrode and a counter electrode arranged to be opposite each other, and a driving section which supplies a data potential to the pixel electrode of each of the plurality of pixels, the method comprising:

controlling the driving section such that, when an image displayed in the display section is rewritten from a first image displayed in a first gray level to a second image including a background image portion to be displayed in the first gray level and a main image portion to be displayed in a second gray level different from the first gray level, a voltage that is the same as a voltage supplied to the counter electrode is supplied to the pixel electrode of the pixel corresponding to the background image portion as the data potential and a voltage corresponding to the second gray level is supplied to the pixel electrode of the pixel corresponding to the main image portion as the data potential, wherein the main image portion of the second image includes an edge portion, and a non-edge portion, the non-edge portion excluding the edge portion, and in the controlling of the driving section when the image displayed in the display section is rewritten from the first image to the second image, the driving section is controlled such that at least one of a magnitude and an application time of the voltage supplied to the pixel electrode is smaller in the pixel corresponding to the edge portion than in the pixel corresponding to the non-edge portion.

2. The method according to claim 1, wherein the second gray level has a plurality of gray levels, and in the controlling of the driving section, at least one value of the magnitude and the application time of the voltage supplied to the pixel electrode in the pixel corresponding to the edge portion is determined on the basis of a gray level difference between a gray level to be displayed in the pixel corresponding to the edge portion and the first gray level.

3. The method according to claim 1, wherein the second gray level has a plurality of gray levels, and in the controlling of the driving section, at least one value of the magnitude and the application time of the voltage supplied to the pixel electrode in the pixel corresponding to the edge portion is determined on the basis of a gray level to be displayed in the pixel corresponding to the edge portion and the first gray level.

4. A control device for an electro-optical device including a display section which has a plurality of pixels each having an electro-optical material between a pixel electrode and a counter electrode arranged to be opposite each other, and a driving section which supplies a data potential to the pixel electrode of each of the plurality of pixels, the control device comprising:

a control unit which controls the driving section such that, when an image displayed in the display section is rewritten from a first image displayed in a first gray level to a second image including a background image portion to be displayed in the first gray level and a main image portion to be displayed in a second gray level different from the first gray level, a voltage that is the same as a voltage supplied to the counter electrode is supplied to the pixel electrode of the pixel corresponding to the background image portion as the data potential and a voltage corresponding to the second gray level is supplied to the pixel electrode of the pixel corresponding to the main image portion as the data potential, wherein the control unit controls the driving section when the image displayed in the display section is rewritten from the first image to the second image such that at least one of a magnitude and an application time of the voltage supplied to the pixel electrode is smaller in the pixel corresponding to an edge portion in the main image portion than in the pixel corresponding to a non-edge portion excluding the edge portion in the main image portion.

5. An electro-optical device comprising:

the control device for an electro-optical device according to claim 4.

6. An electronic apparatus comprising:

the electro-optical device according to claim 5.

* * * * *